US006722647B2

(12) United States Patent
Kato et al.

(10) Patent No.: US 6,722,647 B2
(45) Date of Patent: Apr. 20, 2004

(54) PAPER TRANSPORTING APPARATUS

(75) Inventors: Yasuyuki Kato, Tokyo (JP); Norihisa Isaka, Tokyo (JP)

(73) Assignee: Oki Data Corporation, Tokyo (JP)

( * ) Notice: Subject to any disclaimer, the term of this patent is extended or adjusted under 35 U.S.C. 154(b) by 48 days.

(21) Appl. No.: 10/022,555

(22) Filed: Dec. 17, 2001

(65) Prior Publication Data

US 2002/0074720 A1 Jun. 20, 2002

(30) Foreign Application Priority Data

Dec. 19, 2000 (JP) ..... 2000-384930

(51) Int. Cl.[7] ..... B65H 5/21

(52) U.S. Cl. ..... 271/3.03; 271/145; 271/162; 399/110; 399/124

(58) Field of Search ..... 271/3.03, 145, 271/147, 157, 162; 399/110, 124

(56) References Cited

U.S. PATENT DOCUMENTS 4,165,069 A * 8/1979 Colglazier et al. ..... 271/162
4,553,831 A * 11/1985 Dixon ..... 355/26
4,745,439 A * 5/1988 Hanada et al. ..... 399/124
4,949,134 A * 8/1990 Iwaki et al. ..... 399/402
5,293,203 A * 3/1994 Wada et al. ..... 399/124
5,337,134 A * 8/1994 Sato et al. ..... 399/124
5,666,595 A * 9/1997 Sameshima et al. ..... 399/110
6,145,828 A * 11/2000 Arai ..... 271/3.03
6,580,886 B1 * 6/2003 Howard et al. ..... 399/110

FOREIGN PATENT DOCUMENTS

JP 05268399 A 10/1993

* cited by examiner

*Primary Examiner*—Patrick Mackey
(74) *Attorney, Agent, or Firm*—Akin, Gump, Strauss, Hauer & Feld, L.L.P.

(57) ABSTRACT

A medium transporting apparatus transports a medium along a predetermined transport path. A medium-transporting section is movable between a loading position and an unloading position and has a first transport path. A medium-holding section is movable between the loading position and the unloading position, holds a stack of medium therein, and has a second transport path continuous to the first transport path. A first locking mechanism locks the medium-transporting section to the loading position and unlocks the medium-transporting section from the loading position. A coupling mechanism brings the medium-transporting section and the medium-holding section into coupled engagement with each other and brings the medium-transporting section and the medium-holding section out of coupled engagement with each other. When the first locking mechanism unlocks the medium-transporting section from the loading position, the coupling mechanism brings the medium-transporting section and the medium-holding section into coupled engagement with each other.

8 Claims, 16 Drawing Sheets

PAPER TRANSPORTING APPARATUS

FIELD OF THE INVENTION

The present invention relates to a paper-transporting apparatus for use in an image-recording apparatus capable of printing either on one side of print paper or on both sides.

DESCRIPTION OF THE RELATED ART

A conventional paper-transporting apparatus for use in an image-recording apparatus includes a paper cassette and a paper-transporting unit. The paper cassette accommodates a stack of print paper therein. The paper-transporting unit has a paper-transporting mechanism for flipping over the print paper when printing is performed on both sides of a sheet of print paper. The paper-transporting unit includes a frame that supports drive rollers, an upper cover that supports driven rollers, and other associated structural members that support the upper cover to hold the driven rollers at a predetermined position relative to the drive rollers. The upper cover is provided on a side of the image-recording apparatus from which a user can access the paper-transporting mechanism. When a paper jam occurs, the user draws out the unit assembly from the main body of the image-recording apparatus. Then, the user operates locking members manually to bring the members out of locked engagement with one another before opening the upper cover to remove the jammed paper.

The conventional paper-transporting apparatus suffers from the following problem. When jammed paper is removed from the unit assembly, the user must first take out the unit assembly from the recording apparatus and then open a latching device that holds the upper cover against the frame, before the upper cover can be opened. This operation is complex.

The unit assembly has drive rollers that are rotatable either in a forward or in a reverse direction depending on printing mode, i.e., single-sided printing or double-sided printing, and a plurality of pressure rollers driven by the drive rollers. When the print paper is jammed in the middle of the paper-transporting path, if the paper-transporting unit and paper cassette are taken out separately from the image-recording apparatus, the paper is often broken and a part of it is left in the paper-transporting path. Thus, the paper-transporting unit and paper cassette must be moved separately back and forth until pieces of paper is completely removed from the path. This operation is annoying.

SUMMARY OF THE INVENTION

An object of the present invention is to provide a paper-transporting apparatus in which jammed paper can be taken out completely from the paper-transporting path without difficulty.

A medium transporting apparatus transports a medium along a predetermined transport path. The medium transporting apparatus includes a medium-transporting section movable between a loading position and an unloading position. The medium-transporting section having a first transport path. A medium-holding section is movable between the loading position and the unloading position and holds a stack of medium therein. The medium-holding section has a second transport path continuous to the first transport path. A first locking mechanism locks the medium-transporting section to the loading position and unlocks the medium-transporting section from the loading position. A coupling mechanism brings the medium-transporting section and the medium-holding section into coupled engagement with each other and brings the medium-transporting section and the medium-holding section out of coupled engagement with each other. When the first locking mechanism unlocks the medium-transporting section from the loading position, the coupling mechanism brings the medium-transporting section and the medium-holding section into coupled engagement with each other.

The medium transporting apparatus further comprising a second locking mechanism that locks the medium-holding section to the loading position.

The first locking mechanism and the coupling mechanism includes at least one common post lock member movable between a first position and a second position. When the post lock member moves to the first position, the first locking mechanism locks the medium-transporting section to the loading position and the coupling mechanism brings the medium-transporting section and the medium-holding section out of coupled engagement with each other. When the post lock member moves to the second position, the first locking mechanism unlocks the medium-transporting section to the loading position and the coupling mechanism brings the medium-transporting section and the medium-holding section into coupled engagement with each other.

The post lock member has a first engagement portion and the medium-transporting section that is urged by an urging force outwardly of the medium transporting apparatus and has a front panel having a second engagement portion. When the front panel (is pushed against the urging force, the second engagement portion engages the first engagement portion to hold the post lock member at the second position. When the front panel is released, the second engagement portion disengages from the first engagement portion to allow the post lock member not to hold the post lock member at the second position.

The coupling mechanism includes a first link rotatable in a first plane, a second link pivotally coupled to the first link and rotatable in a second plane substantially perpendicular to the first plane, and a third link pivotally coupled to the second link and rotatable substantially in the second plane. The third link has a hook formed in its free end. The first link rotates by a predetermined angle to cause the third link to pivot so that the hook engages the medium-holding section to bring to bring the medium-transporting section and the medium-holding section into coupled engagement with each other.

The medium transporting apparatus further includes a pull out preventing mechanism that holds the medium-transporting section at the loading position when the medium-holding section is at the unloading position.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DESCRIPTION OF PREFERRED EMBODIMENTS

Embodiments of the present invention will be described in detail with reference to the accompanying drawings.

First Embodiment

Construction

Figure 1:
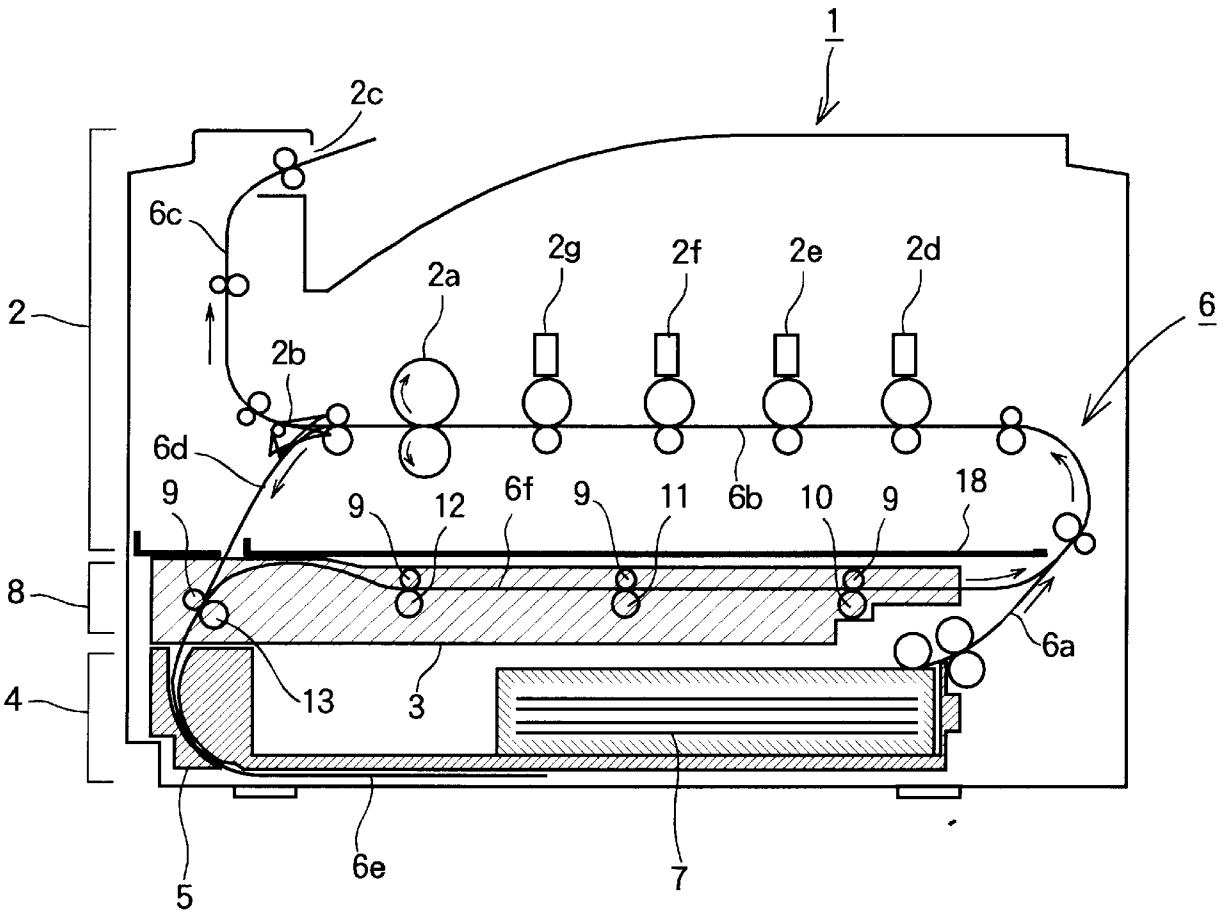
FIG. 1 illustrates a general configuration of an image-recording apparatus having a paper-transporting apparatus according to a first embodiment of the invention.

FIG. 1 illustrates a general configuration of an image-recording apparatus having a paper-transporting apparatus according to a first embodiment of the invention.

Referring to FIG. 1, an image-recording apparatus 1 includes a paper cassette receiving section 4, a paper transporting unit receiving section 8, and a recording section 2. The paper cassette receiving section 4 receives a paper cassette 5 that holds a stack of recording paper 7.

The paper-transporting unit 3 has a transport path continuous to an auxiliary space 6*e* formed in the paper cassette 5 and transports the recording paper 7 along a path 6*f*. The paper-transporting unit 3 can be used both for an image recording apparatus that performs single-sided printing and for an image recording apparatus that performs double-sided printing. The top page of the stack of recording paper 7 held in the paper cassette 5 is fed into a path 6*a* and passes through a path 6*b* in the recording section 2. The recording section 2 performs printing on the recording paper 7 that is transported along the transporting path 6*b*. Four print engines 2*d*–2*g* transfer toner images of corresponding colors sequentially onto the recording paper 7 as the recording paper 7 passes through the path 6*b*. A fixing section 2*a* is disposed shortly after the print engine 2*g* and fuses the toner images transferred on the recording paper 7 into a permanent image. Then, the recording paper 7 is finally guided by a paper guide 2*b* into an appropriate direction.

Figure 2:
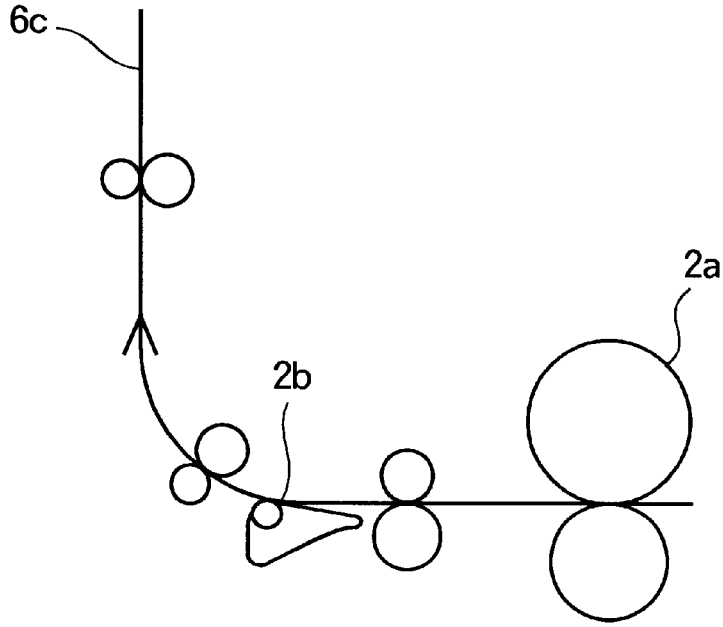
FIG. 2 illustrates the operation of the paper guide when an image is printed only on one side of the recording paper.

FIG. 2 illustrates the operation of the paper guide when an image is printed only on one side of the recording paper 7.

When an image is printed only on one side of the recording paper 7, the paper guide 2*b* is at a position of FIG. 2 so that the printed recording paper 7 advances along a path 6*c* and is discharged through a discharging section 2*c* (FIG. 1).

Figure 3:
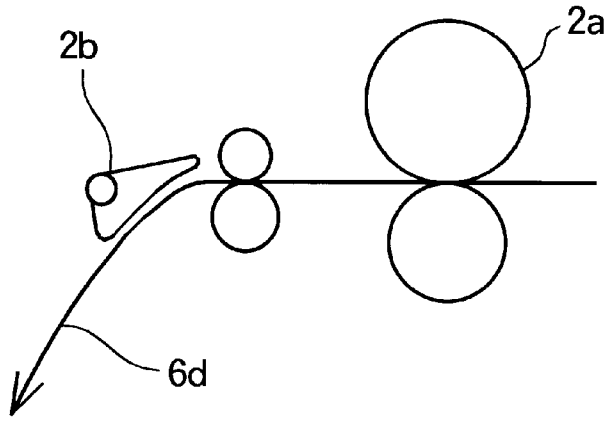
FIG. 3 illustrates the operation of the paper guide when images are printed on both sides of the recording paper.

FIG. 3 illustrates the operation of the paper guide 2*b* when images are printed on both sides of the recording paper 7. When images are printed on both sides of the recording paper 7, the paper guide 2*b* is at a position shown in FIG. 3 so that the recording paper 7 advances along a path 6*d*. Subsequently, the transport rollers 13 (FIG. 1) advance the recording paper 7 into the auxiliary space 6*e* provided under the bottom of the paper cassette 5.

Then, as described later, the transport rollers 13 rotate in a reverse direction so as to advance the recording paper 7 into the path 6*f* in the paper transport unit 3 and then into the path 6*b*. When the recording paper 7 passes through the path 6*b*, images are transferred sequentially onto the backside of the recording paper 7. The recording paper 7 then passes through the fixing section 2*a* and then the paper guide 2*b* at the position of FIG. 2, so that the recording paper 7 is finally discharged from the discharge section 2*c*.

Figure 4:
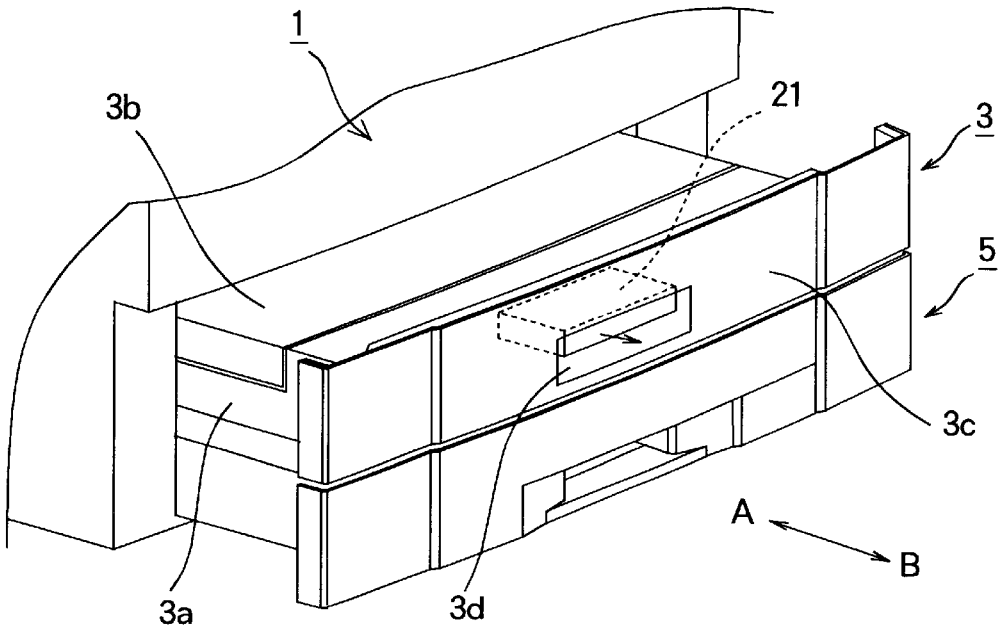
FIG. 4 is a perspective view of the image-recording apparatus.

FIG. 4 is a perspective view of the image-recording apparatus 1, illustrating a paper-transporting unit when the paper-transporting unit is partly drawn out from the main body of an image-recording apparatus.

Referring to FIG. 4, the paper cassette 5 is movable in directions shown by arrow A and B between a loading position where a paper-transporting unit 3 and the paper cassette 5 are attached into the image recording apparatus 1 and an unloading position where the paper-transporting unit 3 and the paper cassette 5 are completely drawn out of the image recording apparatus 1. The paper transporting unit receiving section 8 receives the paper-transporting unit 3 therein such that the paper-transporting unit 3 is movable in the directions shown by arrows A and B between the loading position and unloading position.

The paper-transporting unit 3 includes a frame 3*a* and an upper cover 3*b*. The cover 3*b* of the paper-transporting unit 3 is shown closed. The paper-transporting unit 3 is supported by a guide means, not shown, that guides the paper-transporting unit 3 to slide in the A and B directions.

Figure 5:
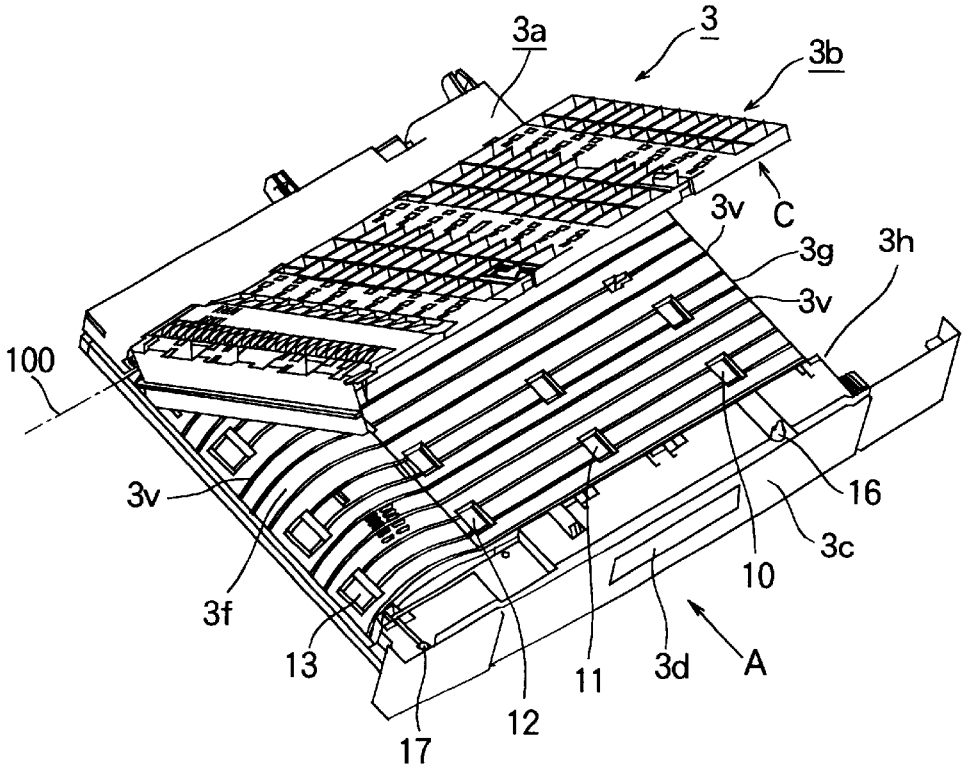
FIG. 5 is a perspective view illustrating the appearance of the paper-transporting unit when the cover is opened.

FIG. 5 is a perspective view illustrating the appearance of the paper-transporting unit 3 when the cover 3*b* is opened.

Referring to FIG. 5, the upper cover 3*b* is supported on the frame 3*a* such that the upper cover 3*b* is pivotal about an axis 100. A paper-transporting section 3*g* defined on the frame 3*a* has four sets 10–13 of transport rollers that rotate about axes substantially perpendicular to the axis 100. The paper-transporting section 3*g* has ribs 3*v* that extend in a direction in which the recording paper 7 is transported. The ribs 3*v* guide the recording paper 7 with least friction when the recording paper 7 passes through the paper-transporting section 3*g*. The frame 3*a* encloses various mechanisms such as a drive motor, a motor driving circuit, a clutch, and a belt, not shown, which cooperate to drive all the transport rollers at a predetermined timing and a speed in the same direction. The frame 3*a* has a partially cylindrical surface 3*f* formed to extend from the left side of the frame 3*a* as seen from the direction shown by arrow A. The set 13 of four drive rollers 13 are provided to extend outwardly of the cylindrical surface 3*f*. A pair of post lock members 16 and 17, which will be described later, are provided on the left and right end portions of the frame 3*a*.

The upper cover 3*b* has four sets of pressure rollers mounted on the underside of the upper cover 3*b*, in pressure contact with four sets 10–13 of drive rollers. The pressure rollers are supported for free rotation.

Figure 6:
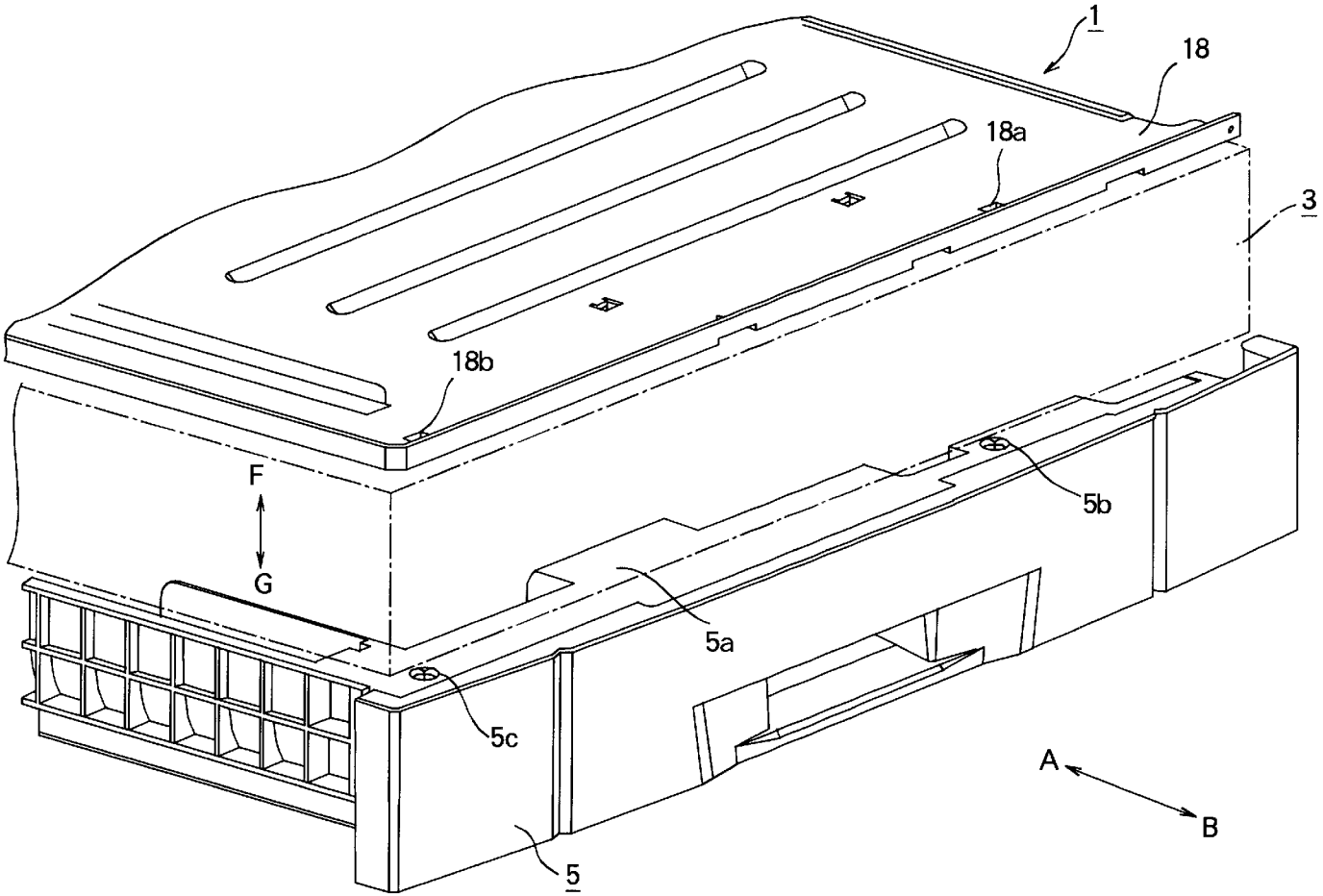
FIG. 6 is an exploded perspective view illustrating the position of a locking mechanism according to the first embodiment housed in the paper-transporting unit.

FIG. 6 is an exploded perspective view illustrating the position of a locking mechanism according to the first embodiment housed in the paper-transporting unit 3. The paper transporting unit 3 is positioned between the upper frame 18 and the paper cassette 5 and FIG. 6 shows only a contour of the paper-transporting unit 3 by phantom lines. The paper-transporting unit 3 and paper cassette 5 are at the loading position so that the recording paper 7 can be transported normally.

Figure 7:
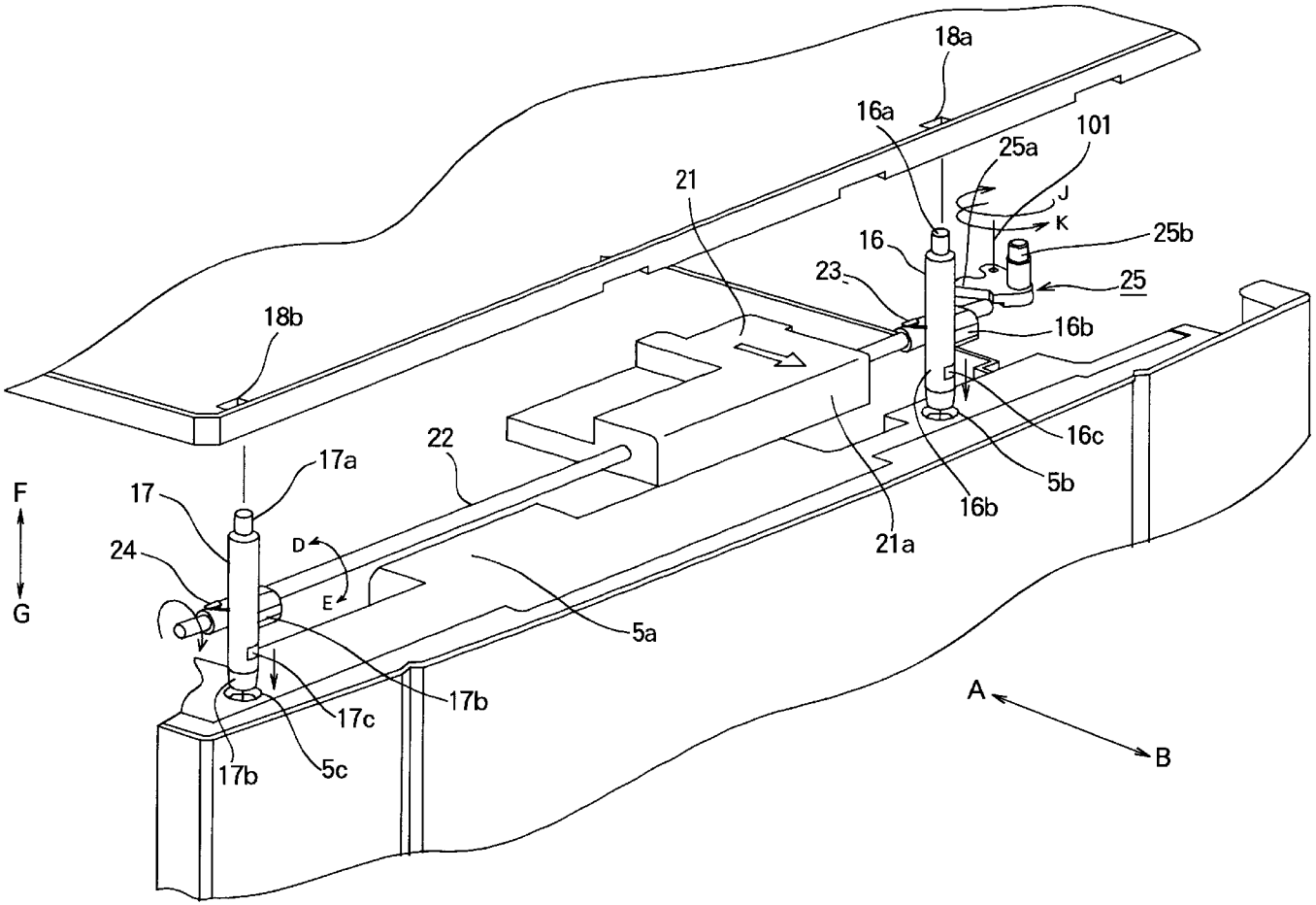
FIG. 7 illustrates the pertinent portion of the paper transporting unit and the paper cassette.

FIG. 7 illustrates the pertinent portion of the paper transporting unit 3 and the paper cassette 5.

The paper transporting unit 3 and the paper cassette 5 are moved in the direction shown by arrows A and B between the loading position and the unloading position.

The upper frame 18 is actually positioned such that end portions 16*a* and 17*a* of the post lock members 16 and 17 fit into fitting holes 18*a* and 18*b*, respectively.

A slide piece 21 has a front handle 21*a* that faces an opening 3*d* (FIG. 4) formed in a front panel 3*c* of the paper-transporting unit 3 and is slidable in the directions shown by arrows A and B. The shaft 22 extends in a direction parallel to the axis 100 (FIG. 5) and is rotatably supported. The slide piece 21 has a rack formed therein, not shown, and the shaft 22 has a pinion formed therein, not shown. Thus, the slide piece 21 and shaft 22 are coupled through a rack-and-pinion mechanism, not shown, so that a linear movement of the slide member 21 in the direction shown by arrows A and B is converted into a rotational movement of the shaft 22 in the directions shown by arrows D and E.

The post lock members 16 and 17 are slidable in directions shown by arrows G and F, perpendicular to the axis 100 and the A and B directions.

Figure 8:
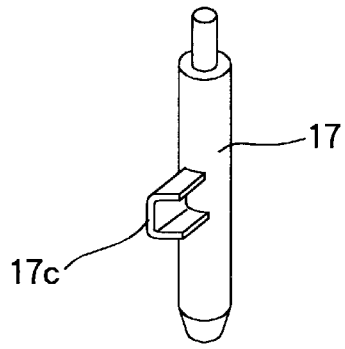
FIG. 8 illustrates post lock member.

FIG. 8 illustrates the post lock member 17.

Figure 9:
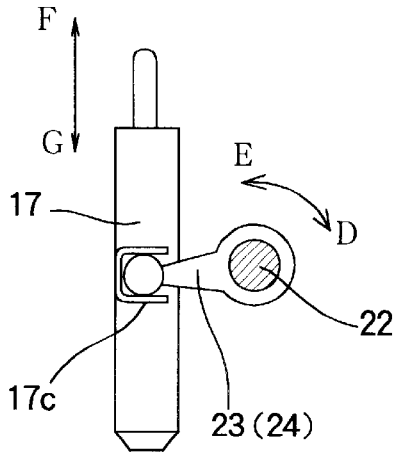
FIG. 9 illustrates the post lock member that engages a lever.

FIG. 9 illustrates the post lock member 17 that engages a lever 23.

Figure 10:
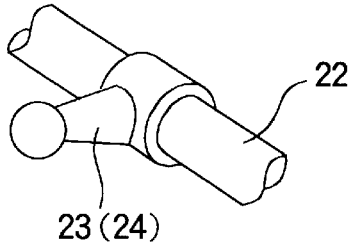
FIG. 10 illustrates the lever mounted on the shaft.

FIG. 10 illustrates the lever 23(24) mounted on the shaft 22.

Levers 23 and 24 are securely mounted to the shaft 22. Each of the levers 23 and 24 has a spherical free end. Each of the post lock members 16 and 17 has a short projection 17*c* with a U-shaped cross-section that engages the lever 23 (24) to form a universal joint, so that a rotational movement of the shaft 22 in the E and D directions is converted into a linear vertical movement of the post lock members 16 and 17 in the G and F directions.

The shaft 22 has an engagement arm 19 (FIG. 17) with a spherical engagement portion 19*a*. The engagement arm 19 is secured to the shaft 22 and is urged by, for example, a spring, not shown, in the D direction.

Figure 11:
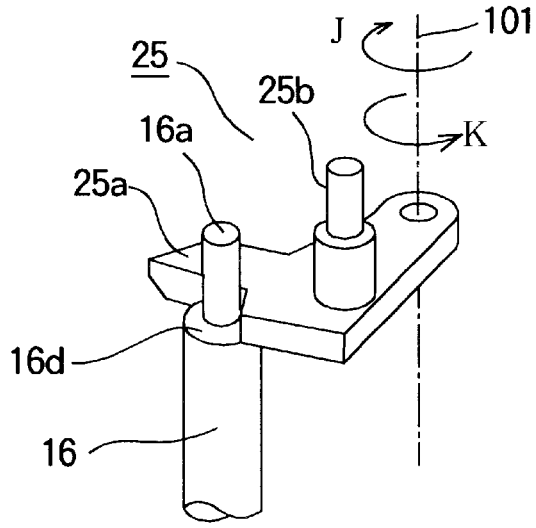
FIG. 11 is an enlarged perspective view of a locking piece of FIG. 17 that engages post lock member.

FIG. 11 is an enlarged perspective view of a locking piece 25 of FIG. 7 that engages the post lock member 16.

Figure 13:
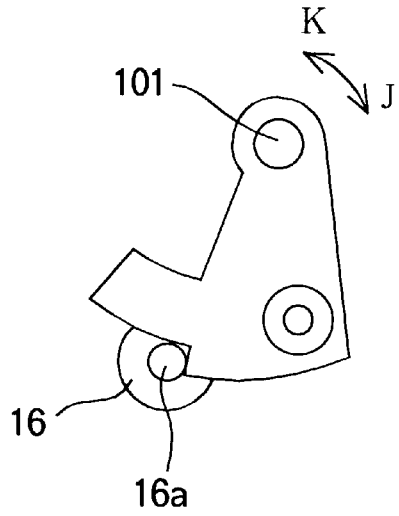
FIG. 13 is an enlarged perspective view of the locking piece that moves out of engagement with the post lock member.

FIG. 13 is a top view of the locking piece of FIG. 11.

Figure 12:
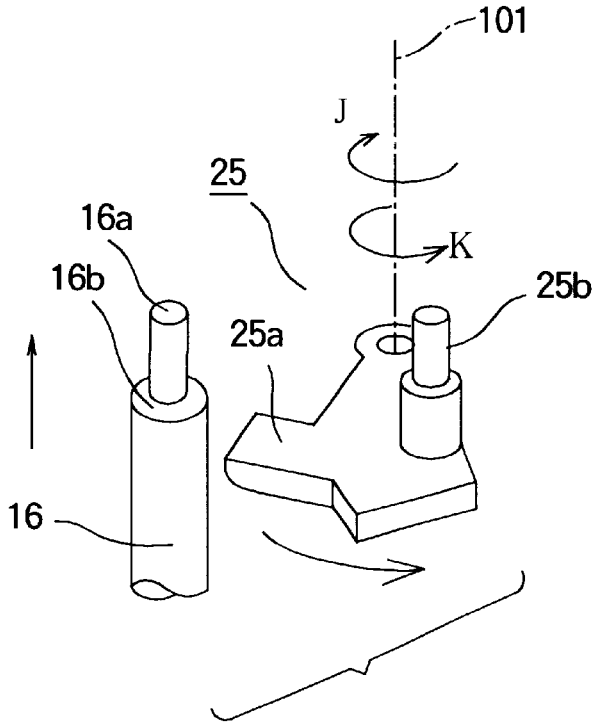
FIG. 12 is a top view of the locking piece of FIG. 11.

FIG. 12 is an enlarged perspective view of the locking piece that moves out of engagement with the post lock member 16.

Figure 14:
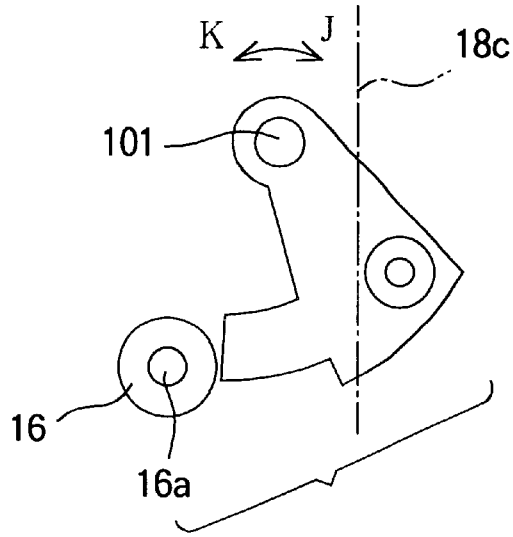
FIG. 14 is a top view of the locking piece and post lock member of FIG. 13.

FIG. 14 is a top view of the locking piece 25 and post lock member 16 of FIG. 12.

As shown in FIGS. 11 and 13, the locking piece 25 is rotatable about an axis 101 parallel to the G and F directions and is urged in a direction shown by arrow J. When the post lock member 16 is moved down into a hole 5*b* formed in a front cover 5*a* of the paper cassette 5, the locking piece 25 rotates in the J direction due to the urging force in the J direction. Thus, as shown in FIG. 11, the locking arm 25*a* moves into engagement with a stepped portion 16*d* formed in an upper portion of the post lock member 16 to prevent the post lock member 16 from moving in the F direction.

As shown in FIGS. 12 and 14, when the locking arm 25*a* is rotated in the K direction, the locking arm 25*a* moves out of engagement with the stepped portion 16*d*.

Operation

The operation of the locking mechanism of the aforementioned construction will be described with reference to FIGS. 1, 6, and 15A–15C.

From Unloading Position to Loading Position

When the paper-transporting unit 3 and paper cassette 5 move from the unloading position to the loading position, the locking mechanism operates as follows.

Figure 15A:
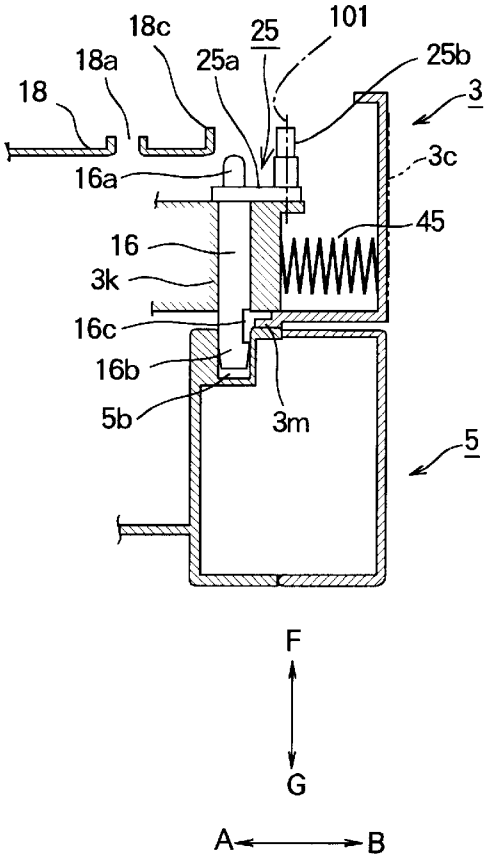
FIGS. 15A–15C illustrate the paper-transporting unit and the paper cassette when they have been drawn out of the apparatus to the unloading position.
Figure 15B:
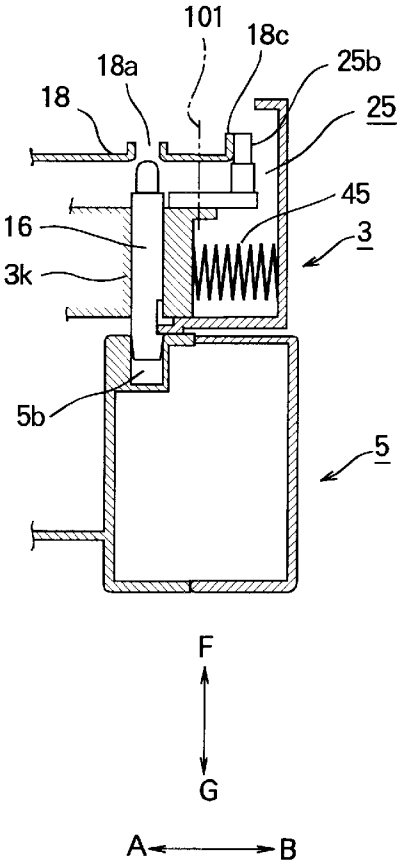
Figure 15C:
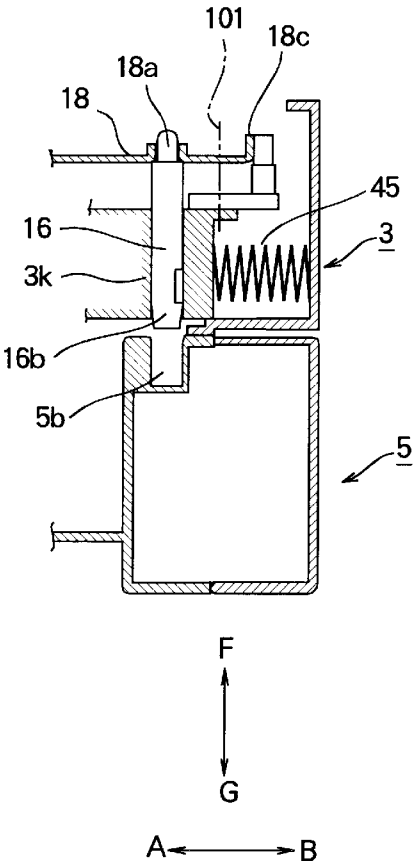

FIGS. 15A–15C illustrate the operation when the paper-transporting unit 3 and paper cassette 5 are moved from the unloading position to the loading position.

FIG. 15A illustrates the paper-transporting unit 3 and the paper cassette 5 when they have been drawn out of the apparatus to the unloading position.

At this moment, the lower end portion 16*b* of the post lock member 16, slidably supported by a chassis 3*k*, fits into the hole 5*b* and is locked by the locking arm 25*a*. The front panel 3*c* is urged by a compression spring 45 in the B direction, so that the front panel 3*c* is supported such that it is slightly movable relative to the chassis 3*k* in the A and B directions.

Likewise, the post lock member 17 (not shown in FIGS. 15A–15C) engages the fitting hole 18*b* and holes 5*c*. This operation is the same as that for the post lock member 16 and the detailed description is omitted.

As shown in FIGS. 15A–15C, the front panel 3*c* of the paper-transporting unit 3 is formed with a projection 3*m*. When the user pushes the front panel 3*c* against a compression spring 45 toward the loading position, the projection 3*m* fits into a recess 16*c* (FIG. 6) formed in the post lock member 16 to prevent the post lock member from moving in the G and F directions.

FIG. 15B illustrates the paper-transporting unit 3 and the paper cassette 5 when they have just reached the loading position.

As the user pushes the front panel 3*c* further, the upper end portion 25*b* of the locking piece is brought into contact with an edge portion 18*c* of the upper frame 18 and the post lock member 16 is immediately below the hole 18*a*. When the user pushes the front panel 3*c* further, the edge portion pushes back the upper end portion 25*b* of the locking piece so that the locking piece rotates in the K direction of FIGS. 7, 11, and 13 to move out of locking engagement with the post lock member 16. At this moment, the projection 3*m* is fitting in the recess 16*c*, preventing the post lock from moving upward.

FIG. 15C illustrates the paper-transporting unit 3 and the paper cassette 5 when the user has just taken his hand after the paper-transporting unit 3 and the paper cassette 5 have reached the loading position.

When the user takes his hand off the front panel 3*c* after the paper-transporting unit 3 and the paper cassette 5 have reached the loading position of FIG. 15B, the spring 45 pushes back the front panel 3*c* so that the projection 3*m* moves out of engagement with recess 16*c*. As soon as the projection 3*m* moves out of engagement with recess 16*c*, the post lock member 16 moves in the F direction into the hole 18*c* and the lower end portion 16*b* of the post lock member moves out of the hole 5*b* formed in the paper cassette 5. The post lock 16 can move in the F direction because the engagement arm 19 is secured to the shaft 22 and is urged by a spring, not shown, in the D direction. Thus, the paper-transporting unit 3 is locked to the loading position and moves out of locked engagement with the paper cassette 5.

From Loading Position to Unloading Position

Referring to FIG. 15C, when the paper-transporting unit 3 and paper cassette 5 are at the loading position, the upper end portions 16*a* of the post lock member 16 remain fitted to the holes 18*a*. Therefore, the paper-transporting unit 3 and paper cassette 5 are prevented from moving in the A and B directions.

Figure 16B:
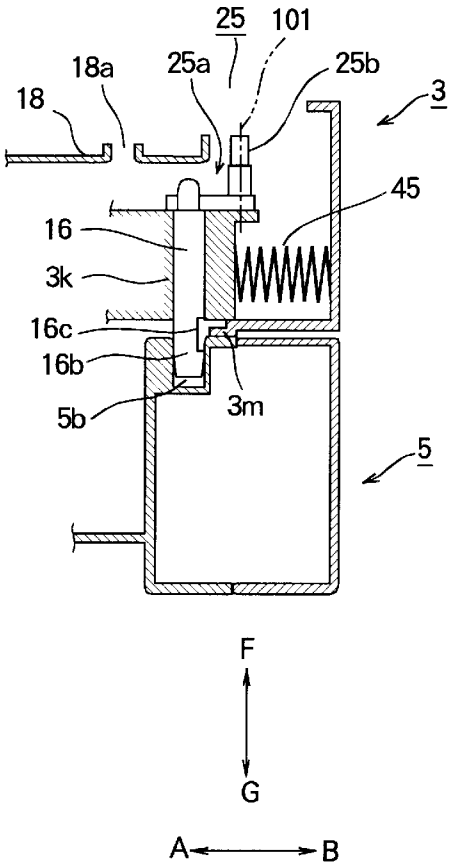
FIG. 16B illustrates the position of the post lock member when the paper-transporting unit and paper cassette moves from the position of FIG. 16A further in the B direction.
Figure 16A:
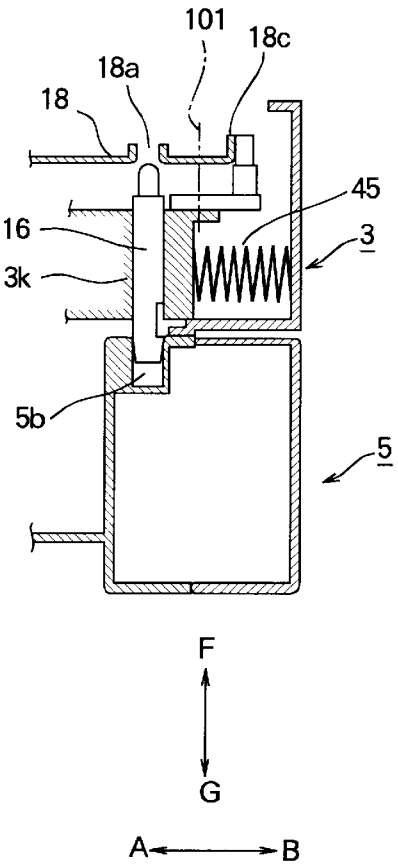
FIG. 16A illustrates the position of the post lock member after the levers caused the post members to move in the G direction.

FIG. 16A illustrates the position of the post lock member 16 after the levers 23 caused the post lock members 16 to move in the G direction.

FIG. 16B illustrates the position of the post lock member 16 when the paper-transporting unit 3 and paper cassette 5 moves from the position of FIG. 16A further in the B direction.

When drawing the paper-transporting unit 3 and paper cassette 5, the user reaches a handle 21*a* (FIG. 7), through an opening 3*d* formed in a front panel 3*c* of the paper transporting unit 3 and pulls the slide member 21 toward the user in the B direction. Then, the shaft 22 rotates in the E direction against the urging force of the spring that urges the shaft 22 in the D direction. The rotation of the shaft 22 causes the levers 23 to move the post lock members 16 in the G direction as shown in FIG. 16A.

Thus, the upper end portion 16*a* of the post lock member 16 moves out of engagement with the hole 18*a* of the upper frame 18. Thus, the paper-transporting unit 3 is no longer locked to the upper frame 18.

At the same time, the lower end portion 16*b* of the post lock member 16 fittingly enters the hole 5*b*, formed in the paper cassette 5. As the paper-transporting unit 3 and paper cassette 5 move in the B direction, the locking piece 25 rotates gradually in the J direction because the locking piece is urged in the J direction. Thus, the locking piece 25 finally engages the post lock member 16 to prevent the post lock member 16 from moving in the F direction as shown in FIG. 16B.

Because the post lock members 16 and 17 are interlocked to each other through the shaft 22, the post lock member 17 also moves in the same directions shown by arrows G and F as the post lock member 16.

The post lock members 16 and 17 remain fitted to the holes 5*b* and 5*c*, so that the paper-transporting unit 3 and paper cassette 5 are locked to each other and can move together in the A and B directions.

Pulling the handle 21*a* of the paper-transporting unit 3 toward the user causes the paper-transporting unit 3 to move out of locked engagement with the image recording apparatus 1. At the same time, the paper-transporting unit 3 becomes in a unitary construction with the paper cassette 5, so that the unitary construction can be drawn out of the image recording apparatus. This structure allows prompt removal of jammed paper when the paper becomes jammed when the recording paper 7 is being fed from the paper cassette to the paper-transporting unit 3. This structure prevents such a case where jammed paper is broken in the apparatus leaving a piece of broken paper.

When the paper-transporting unit 3 and paper cassette 5 are loaded into the apparatus, the post lock members are allowed to move in the F direction only after the paper-transporting unit 3 and the paper cassette 5 have completely reached the loading position as shown in FIGS. 15B and 15C.

Second Embodiment

Construction

Figure 17:
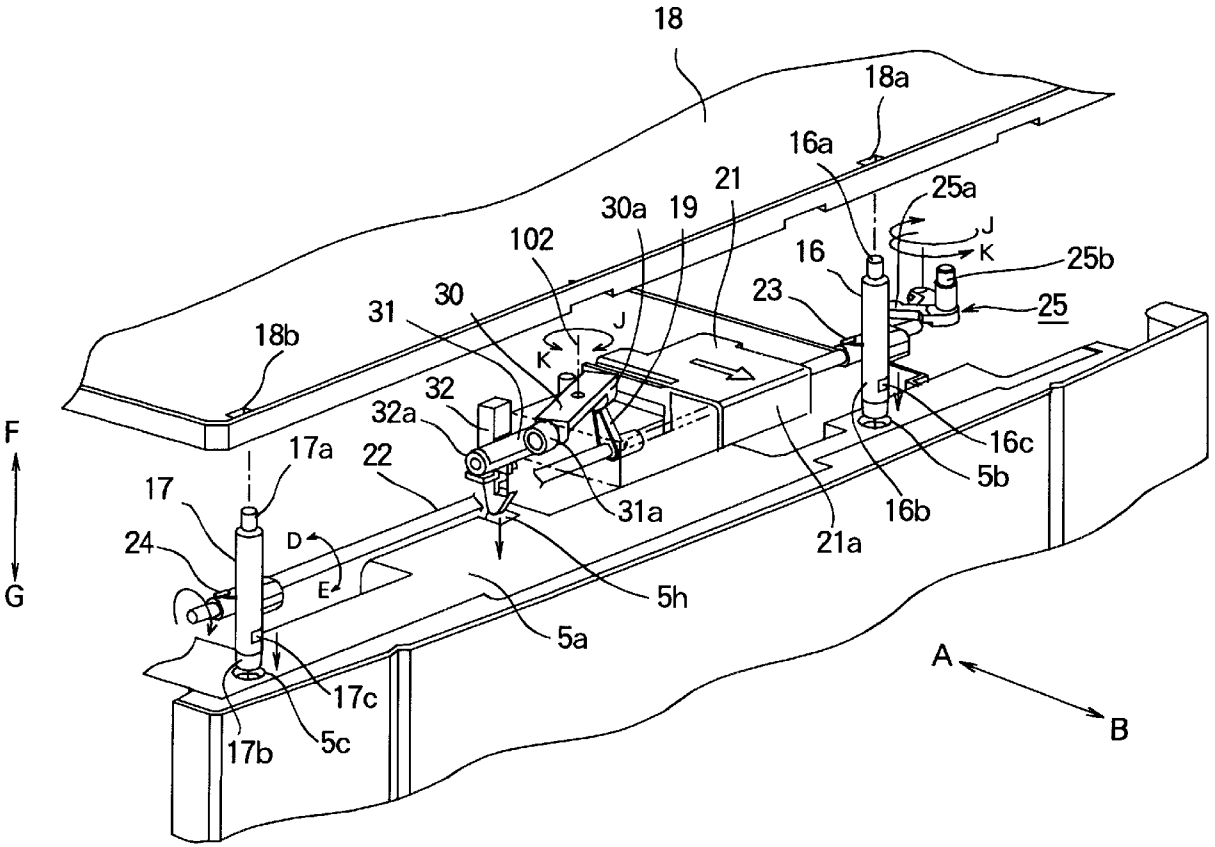
FIG. 17 illustrates a locking mechanism according to a second embodiment, housed in the paper-transporting unit of FIG. 6.

FIG. 17 illustrates a locking mechanism according to a second embodiment, housed in the paper-transporting unit 3 of FIG. 6.

Referring to FIG. 17, a link 30 is supported at its middle portion and is rotatable about an axis 102 parallel to the G and F directions. The link 30 has a downwardly extending cylindrical space, not shown, formed in the underside of one end of the link 30. The cylindrical space receives an engagement ball 19*a* (FIG. 6) of an engagement arm 19 such that the engagement ball 19*a* can move upward and downward in the cylindrical space.

The other end of the link 30 is coupled to one end of a sliding link 31 through a universal coupling 31*a*. The other end of the sliding link 31 is coupled to a pin 32*a* of a locking lever 32 so that the link 31 and the locking lever 32 are rotatable with respect to each other. The locking lever 32 and the sliding link 31 slide on the inner wall surface of the paper-transporting unit 3 as shown in FIGS. 19A–19D.

Figure 18:
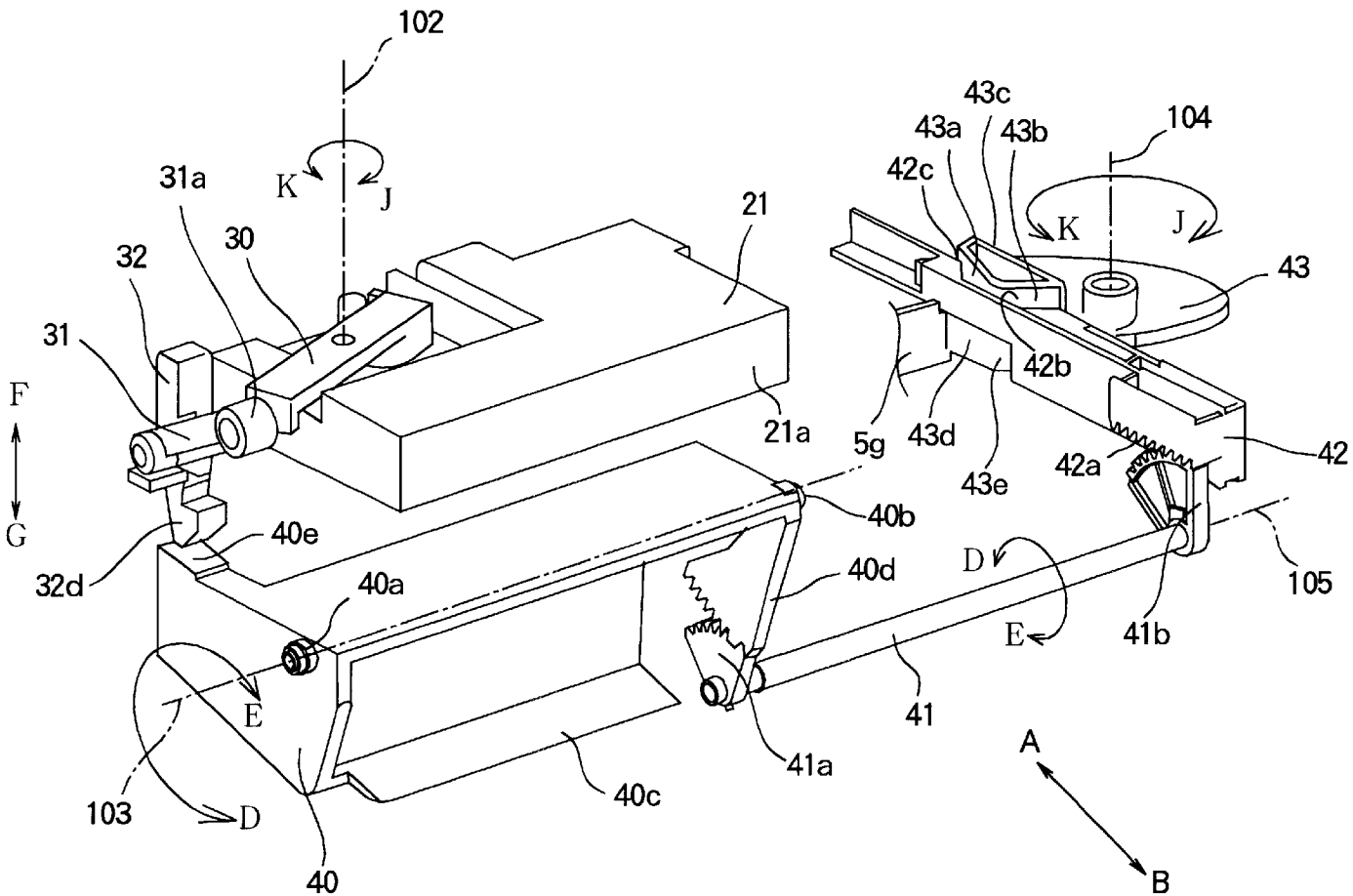
FIG. 18 is a perspective view of a pertinent portion of a cassette-locking mechanism that cooperates with the locking mechanism of FIG. 6.

FIG. 18 is a perspective view of a pertinent portion of a cassette-locking mechanism that cooperates with the locking mechanism of FIG. 6. FIG. 18 shows the cassette locking mechanism when the paper cassette 5 is at the loading position.

A lock-disabling member 40 is in an inner space 5*d* of the front cover 5*a* of the paper cassette 5. The lock-disabling member 40 has a pair of projections 40*a* and 40*b* so that the lock-disabling member 40 is rotatable about an axis 103. The axis 103 passes through the pair of projections 40*a* and 40*b* and is perpendicular to the A and B directions. The handle 40*c* of the lock-disabling member 40 faces an opening 5*f* formed in the front panel 5*e* of the paper cassette 5 as shown in FIG. 17.

A shaft 41 is rotatably supported so that the shaft 41 is rotatable about an axis 105 parallel to the axis 103. The shaft 41 has sector gears 41*a* and 41*b* secured to longitudinal ends of the shaft 41. The gear 41*a* is in mesh with a sector gear 40*d* that is integral with the lock-disabling member 40 and rotates about the axis 103.

A slider 42 is supported such that the slider 42 is slidable in the A and B directions. The slider 42 has a rack gear 42*a* that is in mesh with the gear 41*b* of the shaft 41.

Operation

From Loading Position to Unloading Position

FIGS. 19A–19D illustrate the operation of the link 31 and locking lever 32*m*.

Figures 19A, 19B, 19C, 19D:
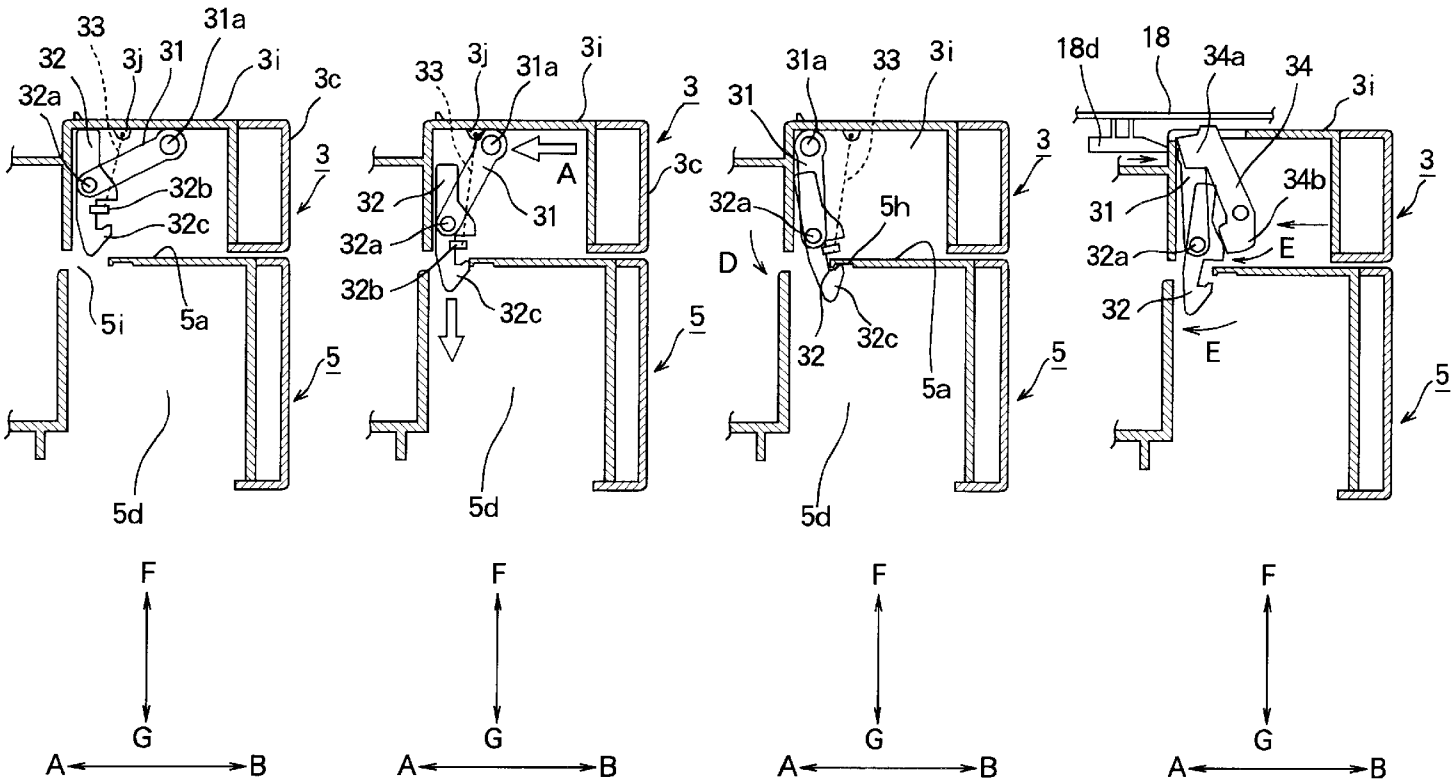
FIGS. 19A–19D illustrate the operation of the link and locking lever.

FIG. 19A illustrates the link 31 and locking lever 32*m* when the paper-transporting unit 3 and the paper cassette 5 are at the loading position.

A tension coil spring 33 is mounted between a spring hook 32*b* formed on the locking lever 32 and a spring hook 3*j* formed on the inner wall of the paper-transporting unit 3.

FIG. 19B illustrates the link 31 and locking lever 32*m* when the front panel 3*c* is pushed into the apparatus toward the loading position. As shown in FIG. 19B, when the link 30 (FIG. 17) rotates in the J direction, the coupling portion 31*a* of the link 31 slides in the A direction, causing the locking lever 32 to move in the G direction against the biasing force of the coil spring 33 while also pressing the locking lever 32 against an inner wall of the cover 3*i* of the paper-transporting unit 3. As the locking lever 32 moves downward, a hook 32*c* of the locking lever 32 enters an opening 51 formed in the front cover 5*a* of the paper cassette 5.

FIG. 19C illustrates the link 31 and locking lever 32*m* when the front panel 3*c* is pushed completely into the apparatus toward the loading position.

As the link 31 further moves in the A direction until the link 31 is blocked by the inner wall of the cover 3*i* as shown in FIG. 19C, the urging force of the coil spring 33 causes the locking lever 32 to rotate in the D direction. This causes the hook 32*c* to engage an engagement portion 5*c* near the opening 5*b*. When the hook 32*c* engages the engagement portion 5*c*, the paper-transporting unit 3 and paper cassette 5 are locked to each other.

Figure 20:
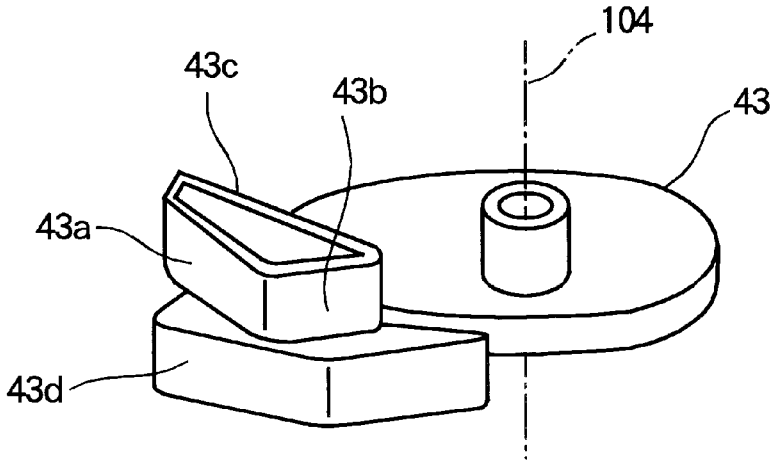
FIG. 20 is a perspective view of the rotating disk.

FIG. 20 is a perspective view of the rotating disk 43.

A rotating disk 43 is rotatable about an axis 104 parallel to the G and F directions and has a projection 43*c* with a pair of beveled surfaces 43*a* and 43*b* formed thereon. The beveled surfaces 43*a* and 43*b* are received in an engagement recess 42*b* having a pair of beveled surfaces.

The lock-disabling member 40 is urged by an urging means, not shown, in the E direction and the rotating disk 43 is urged by an urging means, not shown, in a direction shown by arrow K.

Operation of Locking Mechanism and Cassette-locking Mechanism

The operation of the locking mechanism of FIGS. 17 and 19A–19D and the operations of the cassette-locking mechanism of FIG. 18 will be described.

When the paper-transport unit 3 and the paper cassette 5 are at the loading position, the user pulls the handle 21*a* of the slider 21 toward him so that the shaft 22 rotates in the E direction. As the shaft 22 rotates, the post lock members 16 and 17 move in the G direction so that the upper portions 16*a* and 17*a* move out of the fitting holes 18*a* and 18*b* of the upper frame 18. At this moment, the lower portions 16*b* and 17*b* fit into the holes 5*b* and 5*c* formed in the front cover 5*a* of the paper cassette 5 and the locking piece 25 rotates to lock the post lock members 16 and 17.

When the shaft 22 rotates in the E direction, the link 30 rotates about the axis 102 in the J direction so that the coupling portion 31*a* moves in the A direction. The movement of the coupling portion 31*a* in the A direction causes the locking lever 32 to move in the G direction so that the hook 32*c* engages the engagement portion 5*h* (FIG. 19C). As a result, the paper-transporting unit 2 and the paper cassette 5 are locked to each other.

When the locking lever moves in the G direction, the tip end 32*d* of the locking lever 32 abuts an abutting surface 40*e* of the lock-disabling member 40, causing the lock-disabling member 40 to rotate about the axis 103 in the D direction. The rotation of the lock-disabling member 40 causes the shaft 41 to rotate about the axis 105 in the E direction so that the slider 42 moves in the B direction.

Figure 21:
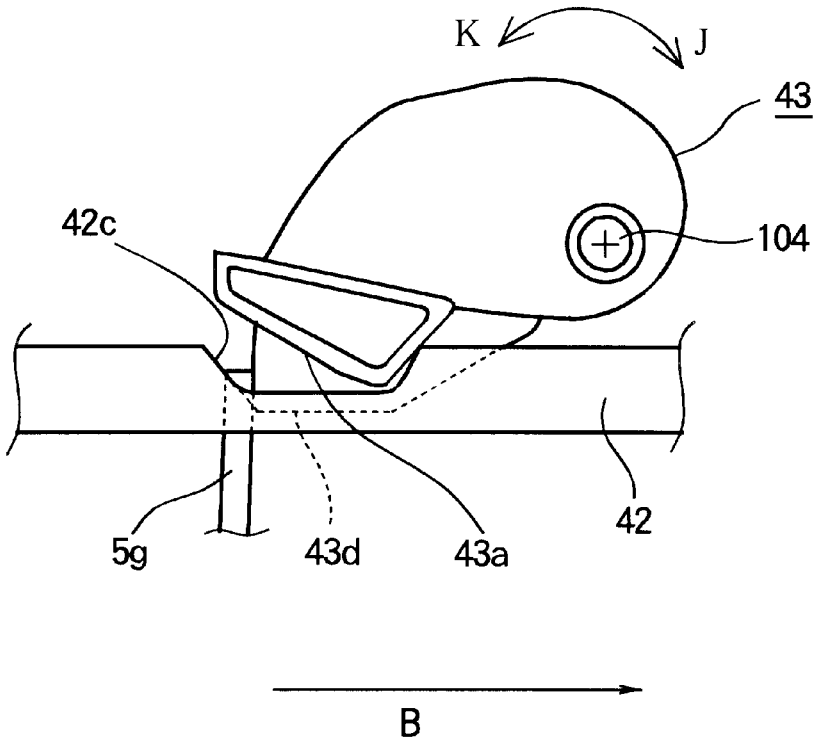
FIG. 21 is a top view of the rotating disk and slider when the paper-transporting unit and paper cassette are at the loading position.

FIG. 21 is a top view of the rotating disk 43 and slider 42 when the paper-transporting unit 3 and paper cassette 5 are at the loading position.

The rotating disk 43 is urged to rotate in the K direction. Thus, when the paper-transporting unit 3 and paper cassette 5 are at the loading position, stopper 43*d* of the rotating disk 43 abuts an engagement portion 5*g* formed on the paper cassette 5 so that the paper cassette 5 cannot be pulled out of the apparatus.

Figure 22:
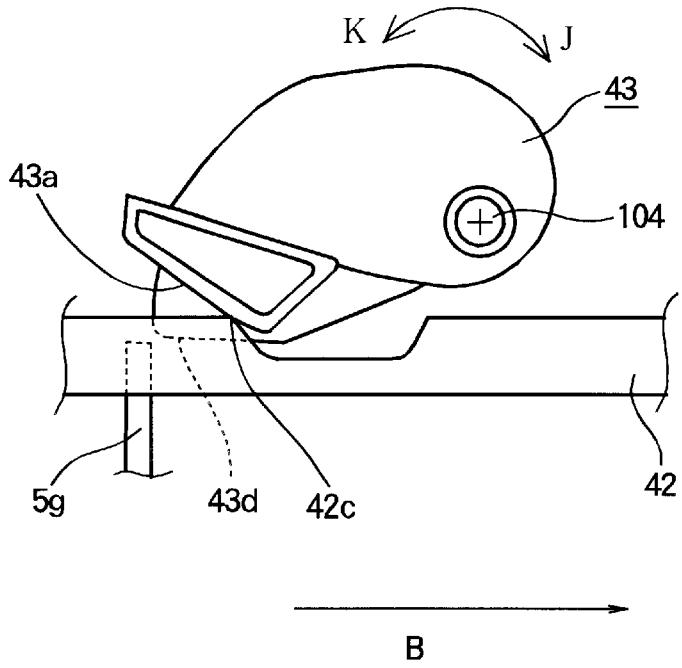
FIG. 22 is a top view of the rotating disk and slider when the paper-transporting unit and paper cassette are at the unloading position.

FIG. 22 is a top view of the rotating disk 43 and slider 42 when the paper-transporting unit 3 and paper cassette 5 are at the unloading position.

When the user pulls the handle 21*a* toward him, the slider 42 moves from the position as shown in FIG. 21 to the position as shown in FIG. 22, a corner 42*c* sliding on the surface 43*a* to push the rotating disk 43 out of the way. Thus, the engagement portion 5*g* becomes free to move in the B direction, so that the paper cassette 5 can move from the loading position to the unloading position.

Operation of Paper-transporting Unit 3 and Paper Cassette 5

The operation of the paper-transporting unit 3 and paper cassette 5 will be described with reference to FIG. 19D.

FIG. 19D illustrates the link 31 and locking lever 32*m* when the user pushes the front panel 3*c* into the apparatus toward the loading position.

Figure 23:
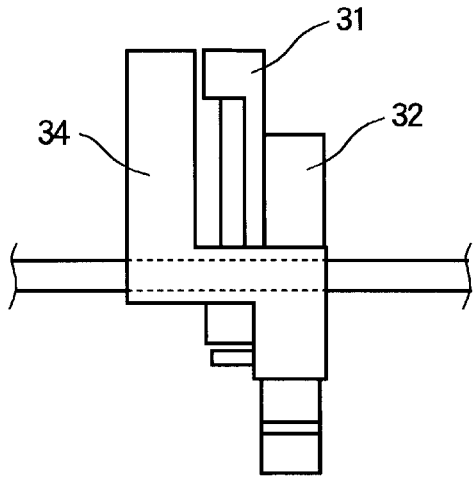
FIG. 23 is a side view of an unlocking lever, the link, and the locking lever as seen in a direction shown by arrow H in FIG. 19D.

FIG. 23 is a side view of an unlocking lever 34, the link 31, and the locking lever 32*m* as seen in a direction shown by arrow H in FIG. 19D.

When the user pushes paper-transporting unit 3 toward the loading position, an abutting end 34*a* of an unlocking lever 34 abuts a projection 18*d* formed on the underside of the upper frame 18. Thus, the projection pushes back the abutting end 34*a* so that the unlocking lever 34 rotates in the E direction. The unlocking lever 34 is rotatable about a shaft 34*c*. The rotation of the unlocking lever 34 causes an end portion 34*b* on the side of the shaft 34*c* remote from the abutting end 34*a* to push the locking lever 32, so that the locking lever 32 rotates about the pin 32*a* in the E direction.

Thus, the hook 32*c* moves out of locking engagement with the engagement portion 5*h*. Thus, the paper-transporting unit 3 and the paper cassette 5 move out of locked engagement with each other.

Pull Out Preventing Mechanism

A pull out preventing mechanism will be described.

The paper-transporting unit 3 is drawn out of the image recording apparatus, for example, when paper is jammed. In contrast, the paper cassette 5 is often drawn out whenever the user replaces the paper therein or places a new stack of paper into the cassette. When the user is replacing the paper into the cassette or placing a new stack of paper into the cassette, the paper-transporting unit 3 should be prevented from coming out of the image recording apparatus. The pull out preventing mechanism prevents the paper-transporting unit 3 from being pulled out when the paper cassette 5 has not been attached into the image recording apparatus.

Figure 24:
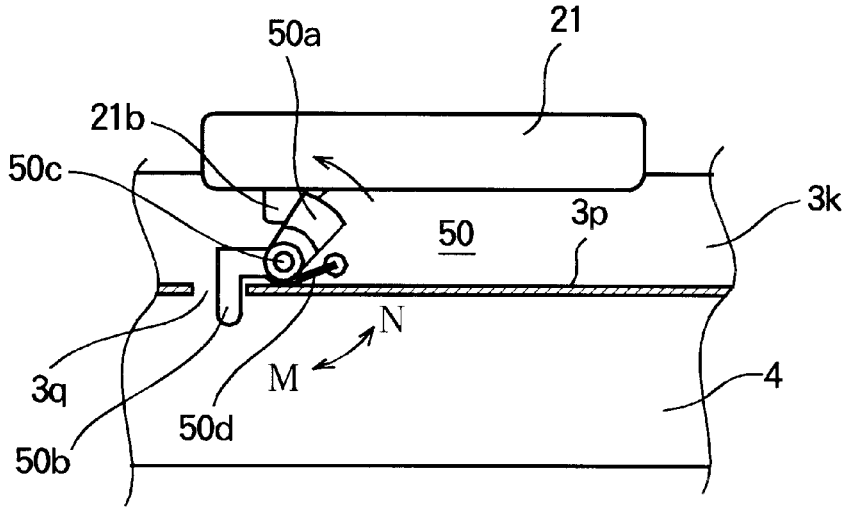
FIGS. 24 and 25 illustrate the pull out preventing mechanism as seen in the A direction in FIG. 17.
Figure 25:
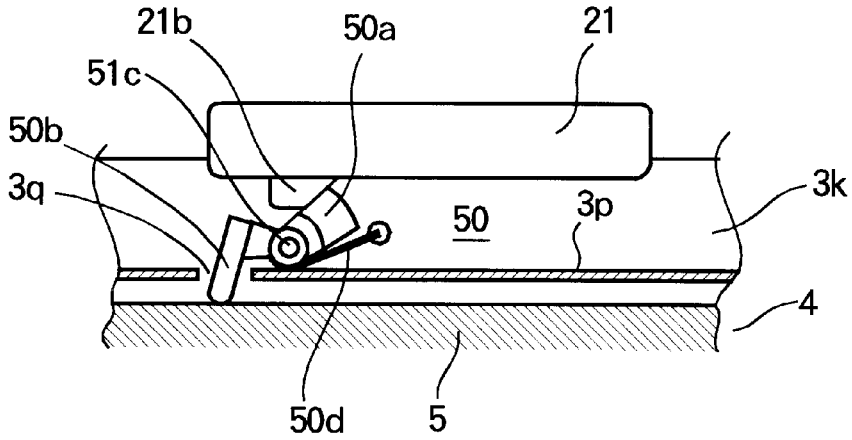

FIGS. 24 and 25 illustrate the pull out preventing mechanism as seen in the A direction in FIG. 17. Referring to FIG. 24, the slider 21 is slidably supported on the chassis 3*k* of the paper-transporting unit 3 (FIG. 17).

A lever 50 is rotatably supported on a bottom 3*p* of the chassis 3*k*, being rotatable about a pin 50*c* parallel to the A and B directions. The lever is urged in a direction shown by arrow N. The lever 50 has an abutting surface 50*a* and a detection pin 50*b*. The abutting surface 50*a* can engage a lower projection 21*b* that projects downwardly from a bottom of the slider 21*b*. The detection pin 50*b* projects downwardly from the lever 50 through an opening 3*q* formed in the bottom 3*p* of the chassis 3*k*.

FIG. 24 is a fragmentary view of the lever 50 and its surroundings when the cassette locking mechanism is disabled.

Thus, the cassette receiving section 4 shown in FIG. 24 is empty. The lever 50 has rotated fully so that the abutting surface 50*a* blocks the projection 21*b* of the slider 21. The slider 21 is prevented from moving toward the user (toward the reader), so that the paper-transporting unit 3 cannot be drawn out alone.

FIG. 25 illustrates a case when the paper cassette is in the cassette receiving section 4. The paper cassette 5 pushes the detection pin 50*b* so that the lever 50 rotates about the pin 50*c* to a position where the lever does not block the projection 21*b*. Thus, the paper-transporting unit 3 can be drawn out alone.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A medium transporting apparatus that transports a medium along a predetermined transport path, comprising:

a medium-transporting section movable between a loading position and an unloading position, said medium-transporting section having a first transport path;

a medium-holding section movable between the loading position and the unloading position, said medium-holding section having a second transport path continuous to the first transport path;

a first locking mechanism that locks said medium-transporting section to the loading position and unlocks said medium-transporting section from the loading position;

a coupling mechanism that brings said medium-transporting section and said medium-holding section into coupled engagement with each other and brings said medium-transporting section and said medium-holding section out of coupled engagement with each other;

wherein when said first locking mechanism unlocks said medium-transporting section from the loading position, said coupling mechanism brings said medium-transporting section and said medium-holding section into coupled engagement with each other.

2. The medium transporting apparatus according to claim 1, further comprising a second locking mechanism that locks said medium-holding section to the loading position.

3. The medium transporting apparatus according to claim 1, wherein said first locking mechanism and said coupling mechanism further comprise at least one common post lock member movable between a first position and a second position;

wherein when the post lock member moves to the first position, the first locking mechanism locks said medium-transporting section to the loading position and said coupling mechanism brings said medium-transporting section and said medium-holding section out of coupled engagement with each other; and wherein when the post lock member moves to the second position, the first locking mechanism unlocks said medium-transporting section from the loading position and said coupling mechanism brings said medium-transporting section and said medium-holding section into coupled engagement with each other.

4. The medium transporting apparatus according to claim 3, wherein the post lock member has a first engagement portion and said medium-transporting section is urged by an urging force outwardly of the medium transporting apparatus and has a front panel having a second engagement portion;

wherein when the front panel is pushed against the urging force, the second engagement portion engages the first engagement portion to hold the post lock member at the second position; and wherein when the front panel is released, the second engagement portion disengages from the first engagement portion to allow the post lock member not to hold the post lock member at the second position.

5. The medium transporting apparatus according to claim 1, wherein said coupling mechanism comprises:

a first link rotatable in a first plane;

a second link pivotally coupled to the first link and rotatable in a second plane substantially perpendicular to the first plane; and a third link pivotally coupled to the second link and rotatable substantially in the second plane, the third link having a hook formed in its free end;

wherein the first link rotates by a predetermined angle to cause the third link to pivot so that the hook engages said medium-holding section to bring to bring said medium-transporting section and said medium-holding section into coupled engagement with each other.

6. The medium transporting apparatus according to claim 1, further comprising a pull out preventing mechanism that holds said medium-transporting section at the loading position when said medium-holding section is at the unloading position.

7. The medium transporting apparatus according to claim 1, wherein when said medium-holding section is moved to the unloading position, said coupling mechanism remains out of coupled engagement with said medium-holding section.

8. The medium transporting apparatus according to claim 1, wherein said medium-holding section has a handle, wherein operating said handle causes said first locking mechanism to unlock said medium-transporting section while at the same time causing said coupling mechanism to couple said medium-transporting section to said medium-holding section.

* * * * *